US011198590B2

(12) United States Patent
Breite et al.

(10) Patent No.: US 11,198,590 B2
(45) Date of Patent: Dec. 14, 2021

(54) ELEVATOR HOISTING MEMBER AND METHOD OF USE

(71) Applicant: ThyssenKrupp Elevator AG, Essen (DE)

(72) Inventors: Christian Breite, Ilmenau (DE); Michael Bray, Sandy Springs, GA (US); Thomas Felis, Atlanta, GA (US)

(73) Assignee: TK Elevator Innovation and Operations GmbH, Essen (DE)

( * ) Notice: Subject to any disclaimer, the term of this patent is extended or adjusted under 35 U.S.C. 154(b) by 907 days.

(21) Appl. No.: 14/695,280

(22) Filed: Apr. 24, 2015

(65) Prior Publication Data

US 2015/0307321 A1 Oct. 29, 2015

Related U.S. Application Data

(60) Provisional application No. 61/984,404, filed on Apr. 25, 2014.

(51) Int. Cl.
*B66B 7/06* (2006.01)
*D07B 1/16* (2006.01)
(Continued)

(52) U.S. Cl.
CPC ..... *B66B 7/062* (2013.01); *B66B 7/06* (2013.01); *D07B 1/02* (2013.01); *D07B 1/16* (2013.01);
(Continued)

(58) Field of Classification Search
CPC ..... B66B 7/06; B66B 7/062; B64G 1/648
(Continued)

(56) References Cited

U.S. PATENT DOCUMENTS

2004/0149485 A1* 8/2004 Edwards ..... B64G 1/648 174/117 R
2011/0259677 A1 10/2011 Dudde et al.
(Continued)

FOREIGN PATENT DOCUMENTS

CH 698843 B1 * 11/2009 ..... D07B 1/141
EP 1674419 6/2006
(Continued)

OTHER PUBLICATIONS

International Search Report and Written Opinion dated Jul. 7, 2015 for Application No. PCT/EP2015/058954.
(Continued)

*Primary Examiner* — Diem M Tran
(74) *Attorney, Agent, or Firm* — Frost Brown Todd LLC

(57) ABSTRACT

A hoisting member for an elevator system includes a core having strength components embedded in a matrix material. A coating can surround the core to protect the core and control the coefficient of friction of the outer surface based on a range of desired friction properties to prevent or inhibit slippage of the hoisting member when used in a traction elevator system. The strength components may be made from carbon nanotube material with the matrix material made from a polymer material. The hoisting member may also include other conductive material or fiber optic material. The hoisting member may also serve as the trailing cable in an elevator system. In doing so the hosting member transmits power and data between the elevator car and the elevator controller thereby eliminating the need for a traditional trailing cable.

19 Claims, 7 Drawing Sheets

(51) Int. Cl.
*D07B 1/02* (2006.01)
*D07B 1/14* (2006.01)

(52) U.S. Cl.
CPC ..... *D07B 1/147* (2013.01); *D07B 2201/209* (2013.01); *D07B 2201/20903* (2015.07); *D07B 2205/3007* (2013.01); *D07B 2501/2007* (2013.01)

(58) Field of Classification Search
USPC ..... 244/158.2
See application file for complete search history.

(56) References Cited

U.S. PATENT DOCUMENTS

2012/0312918 A1* 12/2012 Heppe ..... B64B 1/00 244/30
2014/0305744 A1* 10/2014 Kere ..... B66B 7/1238 187/254
2014/0345978 A1* 11/2014 Alasentie ..... B66B 7/064 187/254
2015/0289708 A1 8/2015 Palazzola et al.
2017/0240382 A1* 8/2017 Orelup ..... B66B 7/062
2018/0282125 A1* 10/2018 Zhao ..... D07B 1/16

FOREIGN PATENT DOCUMENTS

EP 1886961 A1 * 2/2008 ..... B29D 29/10
EP 2138535 12/2009
JP 2001302135 A * 10/2001 ..... B66B 7/1238
WO WO-2009026730 A1 * 3/2009 ..... D07B 1/141
WO WO 2010/019333 2/2010
WO WO-2013110853 A1 * 8/2013 ..... B66B 7/1238

OTHER PUBLICATIONS

Boyd, J., "New nanotech fiber: Robust handling, shocking performance", Rice University, Jan. 10, 2013, 4 pgs. [retrieved from http://news.rice.edu/2013/01/10/new-nanotech-fiber-robust-handling-shocking-performance-2/].
Gay, T., et al., "Stronger than steel: Carbon nanotubes", Boston University, Dec. 15, 2005, 35 pgs. [retrieved from http://www.bu.edu/gk12/marc/Lessons/cnt/cnt_talk.pdf].
Ruoff, R.S., et al., "Mechanical properties of carbon nanotubes: theoretical predictions and experimental measurements," C.R. Physique, 2003, 4:993-1008, 16 pgs.
Teo, K.B.K., et al., "Catalytic Synthesis of Carbon Nanotubes and Nanofibers," Encyclopedia of Nanoscience and Nanotechnology, 2003, X:1-22, 22 pgs.
Canadian Office Action dated Oct. 30, 2017 for Application No. CA 2,976,075, 3 pgs.
Chinese Office Action and Search Report dated Jun. 1, 2018 for Application No. CN 201580022061.0, 9 pgs.
European Communication dated Apr. 9, 2018 for Application No. EP 15 717 512.6, 6 pgs.

* cited by examiner

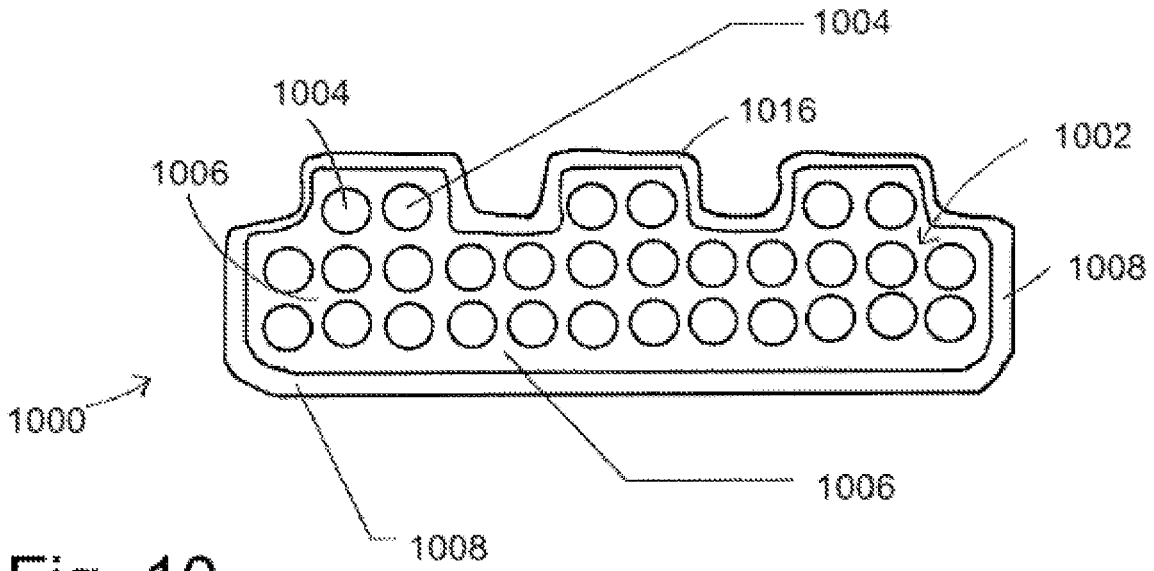
Fig. 10
Fig. 11
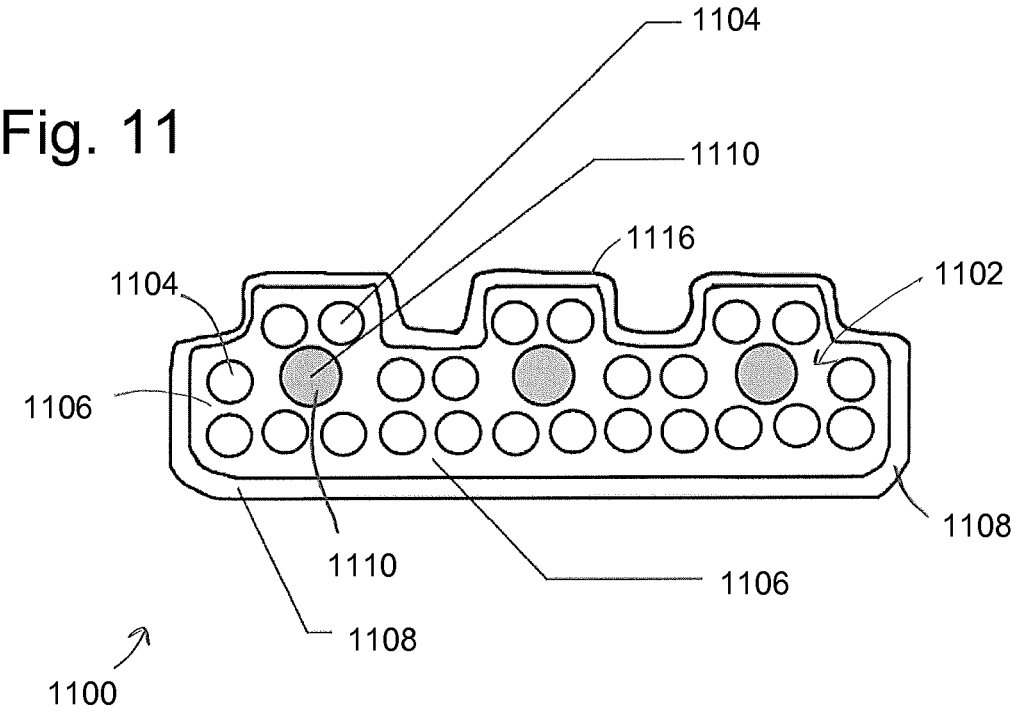

ELEVATOR HOISTING MEMBER AND METHOD OF USE

PRIORITY

This application claims priority to U.S. Provisional Patent Application Ser. No. 61/984,404, filed Apr. 25, 2014, entitled "Elevator Hoisting Member and Method of Use," the disclosure of which is incorporated by reference herein.

BACKGROUND

Elevators are configured with hoisting members in the form of ropes or cables, and also in the form of belts. Elevators also are configured with certain cables, i.e. trailing cables, that transmit power and data to the elevator car. Traditionally hoisting members have been made from steel and trailing cables have been made of electrical power cables and/or serial communication cables, etc.

While a variety of hoisting members and trailing cables have been made and used in elevator systems, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain embodiments taken in conjunction with the accompanying drawings, in which like reference numerals identify the same elements.

FIGS. 10-13 depict example cross-section views of hoisting members in the form of composite belts that have a ribbed surface.

Figure 1:
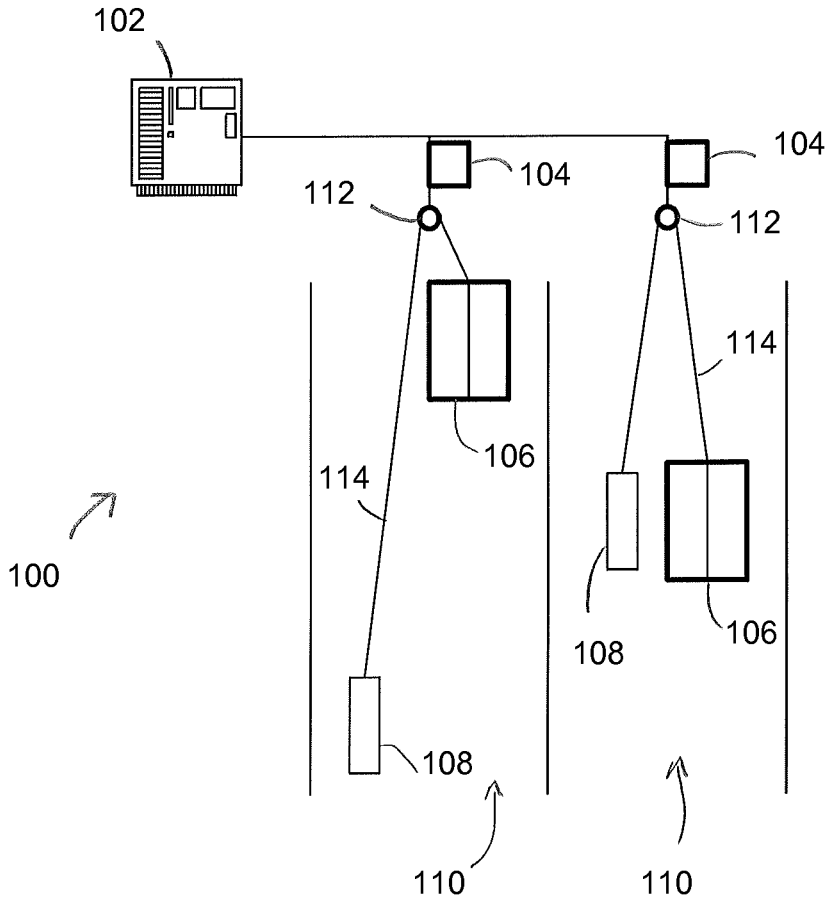
FIG. 1 depicts an example elevator system.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain embodiments of the present disclosure should not be used to limit the scope of the present disclosure. Other examples, features, aspects, embodiments, and advantages of the invention will become apparent to those skilled in the art from the following description, which is by way of illustration, one of the best modes contemplated for carrying out the invention. As will be realized, various aspects of the present disclosure may take alternate forms, or have alternate or additional embodiments, without departing from the scope of the present disclosure. Accordingly, the drawings and descriptions should be regarded as illustrative in nature and not restrictive.

FIG. 1 illustrates an embodiment of an elevator system (100) comprising a controller (102), motors or drives (104), elevator cars (106), counter weights (108), hoistways (110), traction sheaves (112), and hoisting members (114). Elevator system (100) is operable to transport elevator cars (106) through hoistways (110) such that elevator cars (106) can service floors within a building. Those of ordinary skill in the art will understand the various ways to configure and operate elevator system (100).

Figure 2:
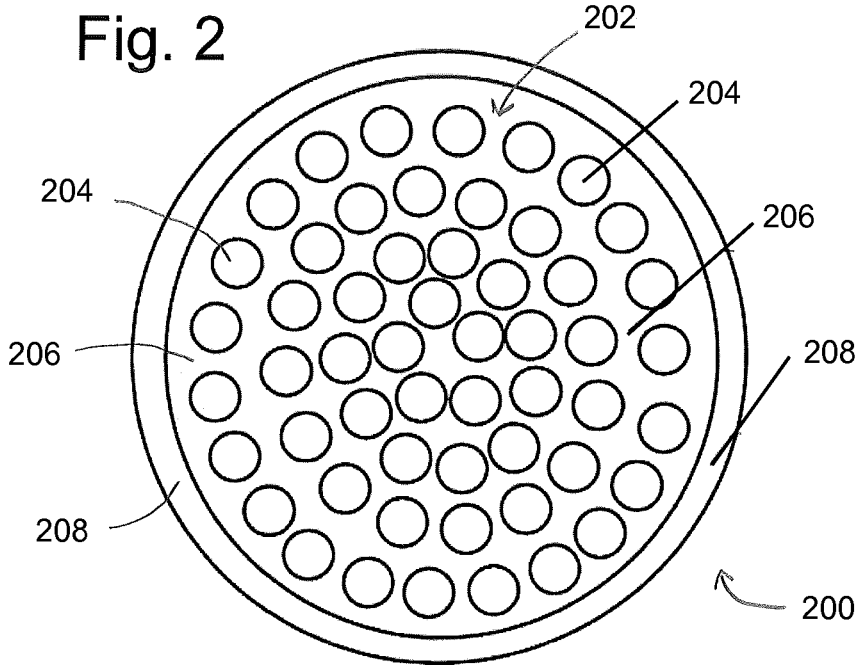
FIGS. 2-8 depict example cross-section views of hoisting members in the form of composite ropes having a circular cross-section.

FIG. 2 depicts a cross-sectional view of an embodiment of a hoisting member (200) that can be used in place of hoisting members (114) in elevator system (100). Hoisting member (200) comprises a composite rope structure that has a core (202) comprised of a strength component (204) and a matrix material (206). Core (202) is surrounded by a coating (208). In the present embodiment, strength component (204) comprises carbon nanotubes (CNT). CNT may refer to a single carbon nanotube, a plurality of carbon nanotubes, a plurality of carbon nanotubes connected to form a carbon nanotube fiber or yarn, a grouping of carbon nanotube fibers or yarns, or a plurality of carbon nanotubes or carbon nanotube fibers or yarns formed in a woven or nonwoven structure. These various configurations for CNT may be referred to as carbon nanotube structures. The CNT are surrounded or embedded in matrix material (206). Matrix material (206) fills out spaces or gaps between CNT and acts as a bonding material holding the CNT together. Using matrix material (206) with strength component (204) creates a solid structure for hoisting member (200). In the present embodiment, matrix material (206) comprises an epoxy resin or elastomer. In some embodiments, matrix material (206) can be a polyester resin, a melamine resin, polyurethane (PU), polyamide (PA), polyethylene (PE), polyether ether ketone (PEEK), or other suitable polymeric resins. In alternate embodiments, the CNT are in the form of lengths of buckypaper surrounded or embedded in matrix material (206). In other embodiments, the CNT are combined with other fibrous materials such as aramid fiber, carbon fiber, fiberglass, natural fibers, etc. Although FIG. 2 shows a plurality of strength components (204) aligned in a circular pattern within core (202), it should be noted that any suitable number of strength components (204) can be used and/or arranged in any suitable pattern within core (202).

Coating (208) surrounds core (202) and protects core (202) while also providing an outer surface where the coefficient of friction of the outer surface can be controlled based on the type of coating (208) used. Those of ordinary skill in the art will understand that the degree of friction for hoisting member (200) helps hoisting member (200) perform in transporting elevator cars in traction elevator systems without excessive slippage of hoisting member (200) when traveling over traction sheaves. In the present embodiment, coating (208) comprises a suitable polymer material, natural or synthetic, e.g. thermoplastics (TP), elastomers, duromers, thermoplastic elastomers (TPE), or rubber. In one embodiment coating (208) comprises PU. Still other suitable materials for coating (208) will be apparent to those of ordinary skill in the art in view of the teachings herein.

In the present embodiment, the CNT are configured to carry the load of elevator cars (106) and/or counter weights (108) of elevator system (100). In some embodiments, the CNT are configured to ensure that predetermined values for elongation of hoisting members (114) are achieved. Incorporating the CNT into strength component (204) can allow strength component (204) and hoisting member (200) to be more lightweight, stronger, and have a greater longevity compared to traditional steel hoisting members. A lighter hoisting member (200) can allow elevator system (100) to include smaller motors or drives (104) due to less load and inertia within elevator system (100), which can also allow elevator system (100) to be easier to install and less costly. A lightweight hoisting member (200) may further reduce the need for a compensation system to account for vibrations in elevator system (100).

In some embodiments, the CNT are configured to transmit electrical signals through hoisting member (200) to provide power to elevator car (106) and/or provide communication between controller (102) and elevator car (106). Accordingly, an additional trailing cable that provides power to elevator car (106) is not required. The removal of a power trailing cable can also make elevator system (100) easier to install and less costly. The use of the CNT to transmit electrical signals can further reduce energy losses within elevator system (100) due to a lower specific resistance of the CNT than the specific resistance of steel which is commonly used in traditional hoisting members.

Hoisting member (200) can be manufactured by pultrusion, braiding, laminating, weaving, knitting, or other suitable infiltration technologies. The manufacturing process can aid in structurally positioning the CNT within core (202). The manufacturing process for a core (202) including CNT can be more cost effective and environmentally friendly due to lower energy consumption during the production process.

Figure 3:
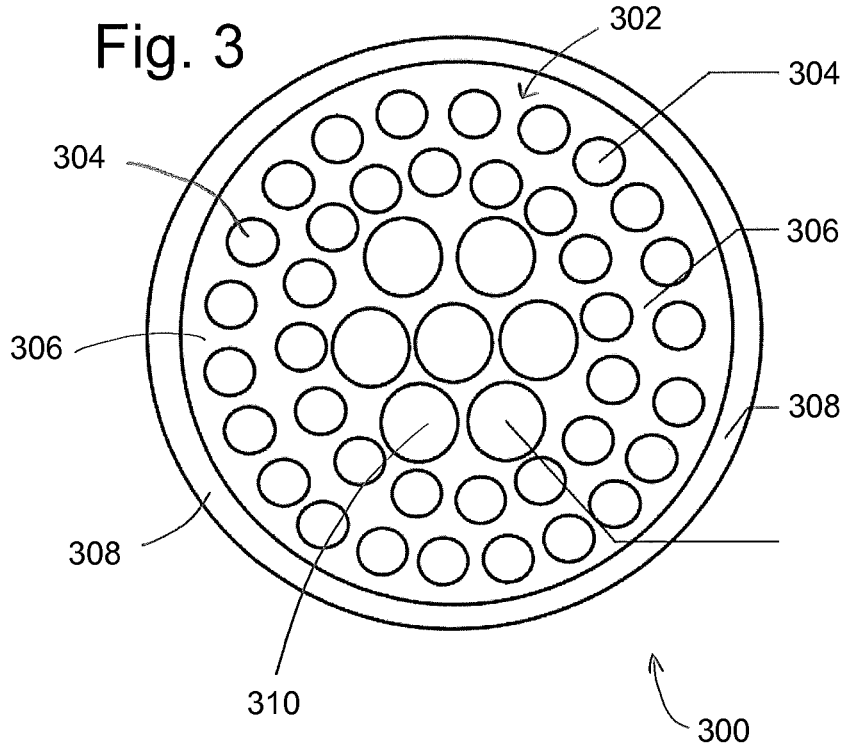

FIG. 3 depicts another cross-sectional view of an embodiment of a hoisting member (300) that can be used in elevator system (100). Hoisting member (300) is similar to hoisting member (200) in that hoisting member (300) comprises a composite rope structure that has a core (302) comprised of a strength component (304) and a matrix material (306). Core (302) is surrounded by a coating (308) to protect core (302) while also providing an outer surface where the coefficient of friction of the outer surface can be controlled based on the type of coating (308) used. Similar to strength member (204), strength component (304) comprises CNT surrounded or embedded in matrix material (306), which fills out spaces or gaps between fibers and acts as a bonding material holding the CNT together.

Core (302) further comprises a data-communication member (310). Data-communication member (310) is configured to transmit data between controller (102) and elevator car (106). In some embodiments, data-communication member (310) can be configured to provide live monitoring of elevator car (106). In the present embodiment, data-communication member (310) is non-load bearing and comprises a plurality of optical fibers comprising fiberglass optics. Of course, other suitable optical fibers for use in data-communication member (310) will be apparent to one of ordinary skill in the art in view of the teachings herein. FIG. 3 shows data-communication member (310) comprising seven optical fibers positioned centrally within core (302). Alternatively, data-communication member (310) can be positioned off-center within core (302) or interspersed throughout core (302) in any suitable arrangement. With data-communication member (310) incorporated in hoisting member (300), an additional trailing cable for data communication is not required. As described above, electrical signals can also be transmitted through the CNT of hoisting member (300) to provide power to elevator car (106) to remove the need for an additional trailing cable for power. Accordingly, with hoisting member (300), in some embodiments, no trailing cables whatsoever are required with elevator system (100).

Figure 4:
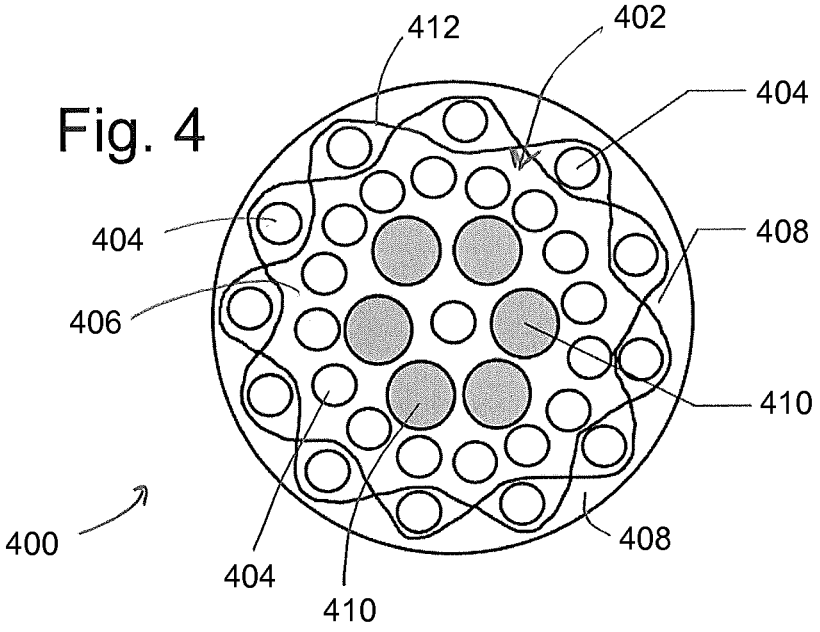

FIG. 4 depicts another cross-sectional view of an embodiment of a hoisting member (400) that can be used in elevator system (100). Hoisting member (400) is similar to hoisting member (300) in that hoisting member (400) comprises a composite rope structure that has a core (402) comprised of a strength component (404), a matrix material (406), and a data-communication member (410) configured to transmit data and/or provide monitoring between controller (102) and elevator car (106). In some embodiments, data-communication member (410) is a conductor configured to transmit power to elevator car (106). Core (402) is surrounded by a coating (408) to protect core (402) while also providing an outer surface where the coefficient of friction of the outer surface can be controlled based on the type of coating (408) used. Similar to strength member (304), strength component (404) in some embodiments comprises CNT surrounded or embedded in matrix material (406), which fills out spaces or gaps between fibers and acts as a bonding material holding the CNT together.

Hoisting member (400) further comprises a sheathing (412) positioned (e.g. by braiding or weaving etc.) around a portion of the CNT. In the present embodiment, sheathing (412) is positioned around an outer ring of the CNT. Of course, sheathing (412) can be positioned around any portion and/or all of the CNT as apparent to one of ordinary skill in the art in view of the teachings herein. In some embodiments sheathing (412) comprises CNT tapes, while in other embodiments sheathing (412) is comprised of lengths of buckypaper. Still yet in other embodiments sheathing (412) can be comprised of other materials such as polyurethane, graphene, aramid fiber, carbon fiber, fiberglass, or nylon. In some embodiments, sheathing (412) provides additional structural support for hoisting member (400). In other embodiments, electrical signals are transmitted through sheathing (412) to provide power to elevator car (106). Other suitable configurations for hoisting member (400) will be apparent to one of ordinary skill in the art in view of the teachings herein.

Figure 5:
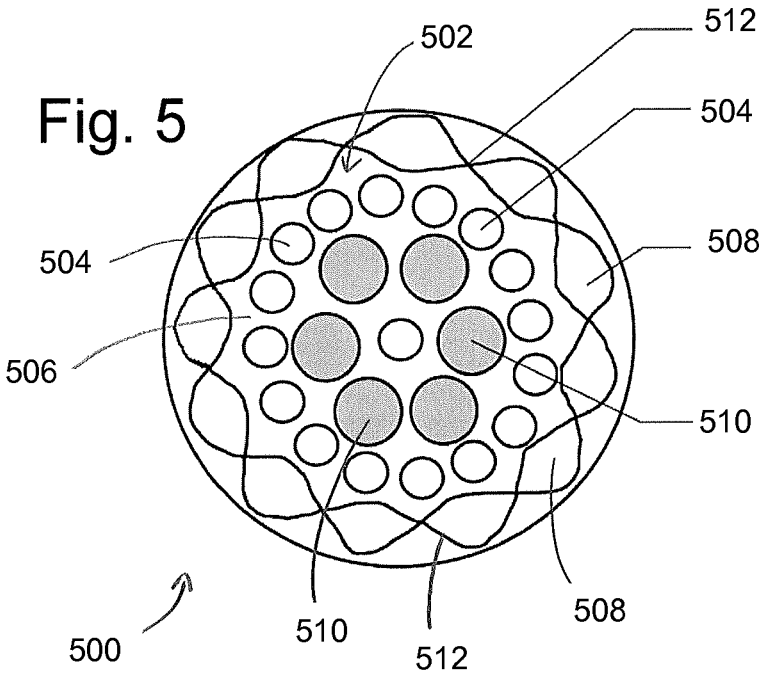

FIG. 5 depicts another cross-sectional view of an embodiment of a hoisting member (500) that can be used in elevator system (100). Hoisting member (500) is similar to hoisting member (400) depicted in FIG. 4, in that hoisting member (500) comprises a composite rope structure that has a core (502) comprised of a strength component (504), a matrix material (506), and a data-communication member (510) configured to transmit data and/or provide monitoring between controller (102) and elevator car (106). In some embodiments, data-communication member (510) is a conductor configured to transmit power to elevator car (106). Similar to strength member (404), strength component (504) comprises CNT surrounded or embedded in matrix material (506), which fills out spaces or gaps between fibers and acts as a bonding material holding the CNT together. Core (502) is surrounded by a coating (508) to protect core (502) while also providing an outer surface where the coefficient of friction of the outer surface can be controlled based on the type of coating (508) used. Hoisting member (500) further comprises sheathing (512) that is similar to sheathing (412) depicted in FIG. 4, except that sheathing (512) is positioned or placed (e.g. by braiding or weaving etc.) throughout coating (508). In the present embodiment, sheathing (512) is positioned around the entire ring of coating (508). Of course, sheathing (512) can be positioned around any portion of coating (508), as will be apparent to one of ordinary skill in the art in view of the teachings disclosed herein.

Figure 6:
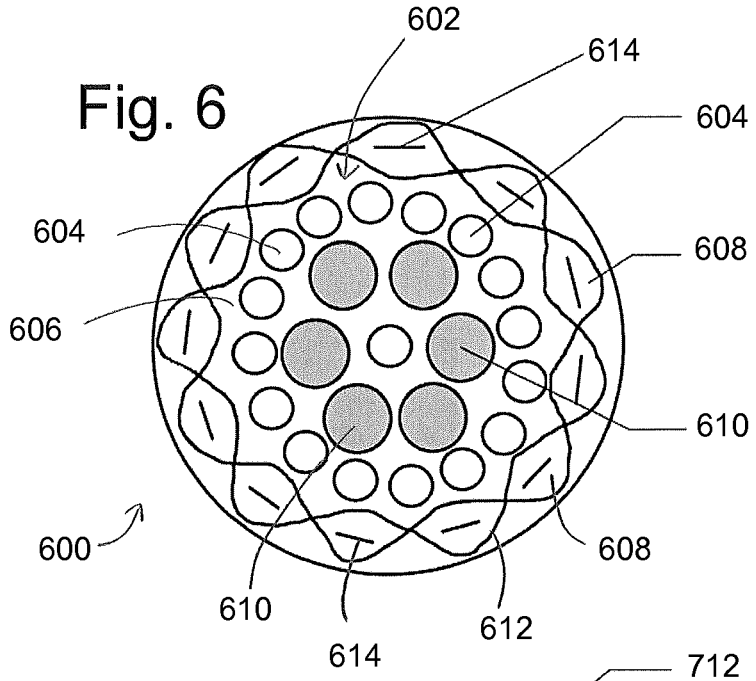

FIG. 6 depicts another cross-sectional view of an embodiment of a hoisting member (600) that can be used in elevator system (100). Hoisting member (600) is similar to hoisting member (500) depicted in FIG. 5, in that hoisting member (600) comprises a composite rope structure that has a core (602) comprised of a strength component (604), a matrix material (606), and a data-communication member (610) configured to transmit data and/or provide monitoring between controller (102) and elevator car (106). In some embodiments, data-communication member (610) is a conductor configured to transmit power to elevator car (106). Similar to strength member (504) depicted in FIG. 5, strength component (604) comprises CNT surrounded or embedded in matrix material (606), which fills out spaces or gaps between fibers and acts as a bonding material holding the CNT together. Core (602) is surrounded by a coating (608) to protect core (602) while also providing an outer surface where the coefficient of friction of the outer surface can be controlled based on the type of coating (608) used. Hoisting member (600) further comprises sheathing (612) positioned or placed (e.g. by braiding or weaving etc.) throughout coating (608), similar to sheathing (512).

In the present embodiment, core (602) further comprises a plurality of long narrow strips of fiber tapes (614). In one embodiment, fiber tape (614) may comprise bucky paper. In alternative embodiments the fiber tape (614) may comprise CNT braided or woven into a flat, flexible, tape-like structure of any appropriate or desired length. However, in yet further embodiments, fiber tapes may comprise graphene, layers of graphene in a polyurethane or epoxy resin, a group of fibers bound by an epoxy resin, or carbon fiber without departing from the scope of the present disclosure. Fiber tapes (614) are positioned around the entire ring of coating (608). In alternate embodiments, fiber tapes (614) are positioned throughout a smaller portion of coating (608) and/or interspersed throughout coating (608). In additional alternate embodiments, fiber tapes (614) can be positioned within core (602) without departing from the scope of the present disclosure. Fiber tapes (614) can extend the length of hoisting member (600) and be configured to transmit electrical signals to provide power to elevator car (106). In addition, fiber tapes (614) may be configured to provide additional structural support to hoisting member (600). Furthermore, as can be seen in the embodiment depicted in FIG. 6, sheathing (612) may be braided around the plurality of fiber tapes (614) with areas of coating (608) disposed outside of sheath (612).

Figure 7:
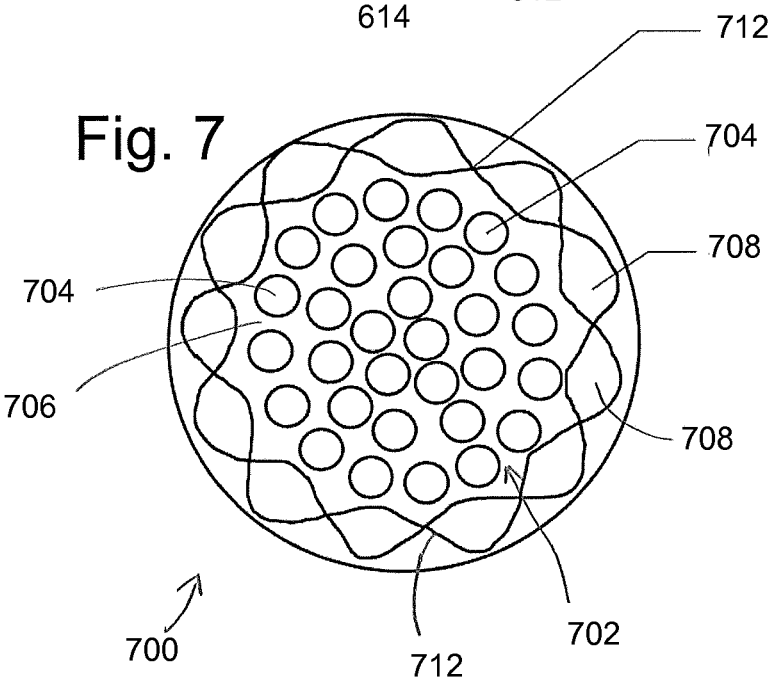

FIG. 7 depicts another exemplary embodiment of a hoisting member (700) that can be used in elevator system (100). Hoisting member (700) is similar to hoisting member (500) shown in FIG. 5, in that hoisting member (700) comprises a composite rope structure that has a core (702) comprised of a strength component (704) and a matrix material (706), without a data-communication member. Similar to strength member (504) from FIG. 5, strength component (704) comprises CNT surrounded or embedded in matrix material (706), which fills out spaces or gaps between fibers and acts as a bonding material holding the CNT together. Core (702) is surrounded by a coating (708) to protect core (702) while also providing an outer surface where the coefficient of friction of the outer surface can be controlled based on the type of coating (708) used. Hoisting member (700) further comprises sheathing (712) positioned or placed (e.g. by braiding or weaving etc.) throughout coating (708), similar to sheathing (512) from FIG. 5.

Figure 8:
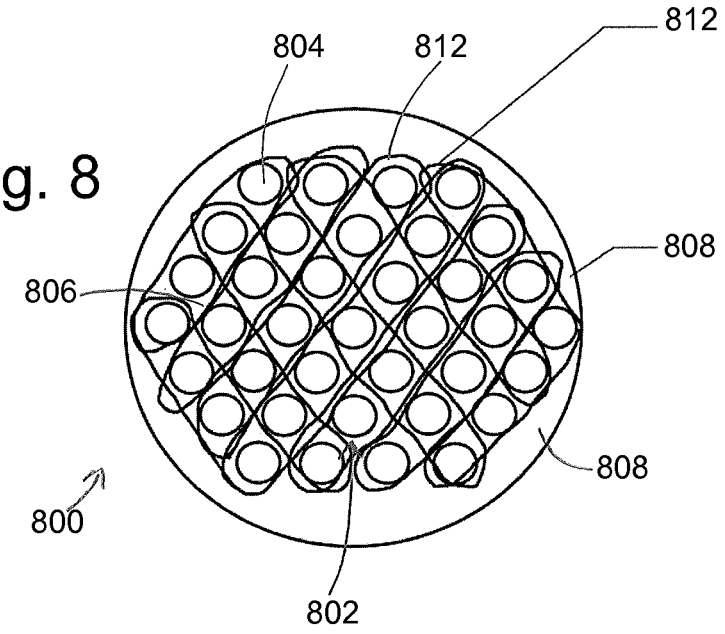

FIG. 8 depicts another exemplary cross-sectional view of an embodiment of a hoisting member (800) that can be used in elevator system (100). Hoisting member (800) is similar to hoisting member (700) from FIG. 7, in that hoisting member (800) comprises a composite rope structure that has a core (802) comprised of a strength component (804) and a matrix material (806). In the illustrated embodiment, core (802) has a hexagonal cross-section. Similar to the strength member (704) depicted in FIG. 7, strength component (804) comprises CNT surrounded or embedded in matrix material (806), which fills out spaces or gaps between fibers and acts as a bonding material holding the CNT together. Core (802) is surrounded by a coating (808) to protect core (802) while also providing an outer surface where the coefficient of friction of the outer surface can be controlled based on the type of coating (808) used. Hoisting member (800) further comprises sheathing (812), similar to sheathing (712) in FIG. 7, except that sheathing (812) is positioned or placed (e.g. by braiding or weaving etc.) throughout core (802). FIG. 8 further shows sheathing (812) positioned around each row and column of the CNT. As will be apparent to one of ordinary skill in the art in view of the teachings herein, sheathing (812) can be positioned through any suitable portion of the CNT.

Figure 9:
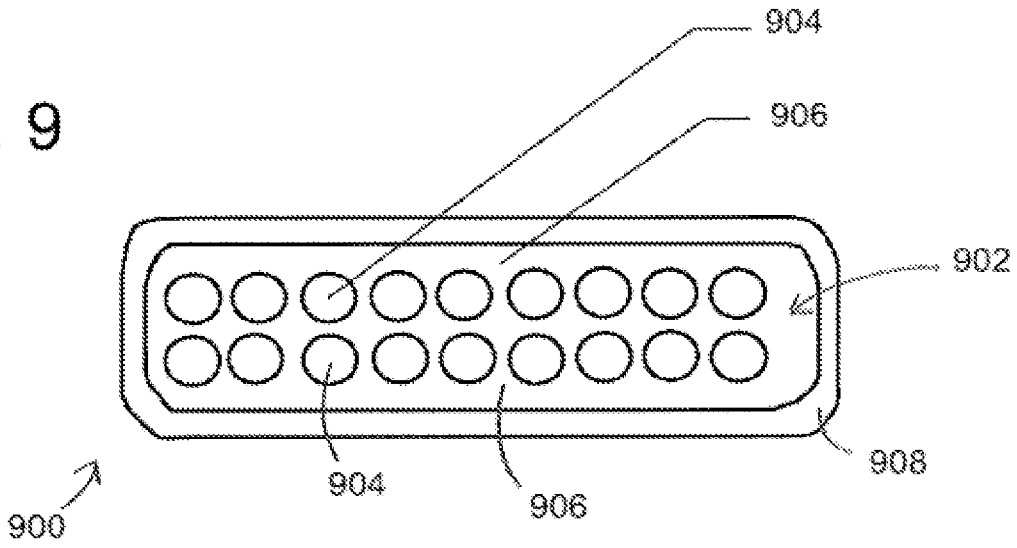
FIG. 9 depicts an example cross-section view of a hoisting member in the form of a composite belt having a rectangular cross-section.

While FIGS. 2-8 respectively depict hoisting members (200, 300, 400, 500, 600, 700, 800) having circular cross-sections, hoisting members (200, 300, 400, 500, 600, 700, 800) can include other suitably shaped cross-sections (e.g., square, rectangular, triangular, hexagonal, octagonal, etc.). For example, FIG. 9 depicts an exemplary cross-sectional view of an embodiment of a hoisting member (900) in the form of a composite belt having a rectangular cross-section. Hoisting member (900) can be used in elevator system (100). Hoisting member (900) is similar to hoisting member (200) in that hoisting member (900) comprises a composite rope structure that has a core (902) comprised of a strength component (904) and a matrix material (906). Similar to strength member (204), strength component (904) comprises CNT surrounded or embedded in matrix material (906), which fills out spaces or gaps between fibers and acts as a bonding material holding the CNT together. Core (902) is surrounded by a coating (908) to protect core (902) while also providing an outer surface where the coefficient of friction of the outer surface can be controlled based on the type of coating (908) used.

FIG. 10 depicts another cross-sectional view of an alternate embodiment of a hoisting member (1000) in the form of a composite belt having a ribbed surface. Hoisting member (1000) can be used in elevator system (100) and is similar to hoisting member (900) in that hoisting member (1000) comprises a composite rope structure that has a core (1002) comprised of a strength component (1004) and a matrix material (1006). Similar to strength member (904), strength component (1004) comprises CNT surrounded or embedded in matrix material (1006), which fills out spaces or gaps between fibers and acts as a bonding material holding the CNT together. Core (1002) is surrounded by a coating (1008) to protect core (1002) while also providing an outer surface where the coefficient of friction of the outer surface can be controlled based on the type of coating (1008) used. FIG. 10 shows that hoisting member (1000) further comprises a plurality of ribs (1016) protruding outwardly from an exterior surface of hoisting member (1000). Ribs (1016) may be complimentary to, and/or ride within, a grooved or patterned surface of traction sheave (112) to prevent slipping of hoisting member (1000) during operation of elevator system (100).

FIG. 11 depicts a cross-sectional view of yet another embodiment of a hoisting member (1100) in the form of a composite belt having a ribbed surface. Hoisting member (1100) can be used in elevator system (100) and is similar to hoisting member (1000) in that hoisting member (1100) comprises a composite rope structure that has a core (1102) comprised of a strength component (1104) and a matrix material (1106). Similar to strength member (1004), strength component (1104) comprises CNT surrounded or embedded in matrix material (1106), which fills out spaces or gaps between fibers and acts as a bonding material holding the CNT together. Core (1102) is surrounded by a coating (1108) to protect core (1102) while also providing an outer surface where the coefficient of friction of the outer surface can be controlled based on the type of coating (1108) used. Hoisting member (1100) comprises a plurality of ribs (1116), similar to ribs (1016), positioned on an exterior surface of hoisting member (1100). In the present embodiment of FIG. 11, hoisting member (1100) further comprises data-communication member (1110) configured to transmit data and/or provide monitoring between controller (102) and elevator car (106). In some embodiments, data-communication member (1110) is a conductor configured to transmit power to elevator car (106). FIG. 11 shows data-communication member (1110) comprising three fiber optic cables laterally aligned adjacent to ribs (1116). As should be apparent to one of ordinary skill in the art, in view of the teachings herein, hoisting member (1100) can include any suitable number of optical fibers positioned at any suitable location within core (1102).

Figure 12:
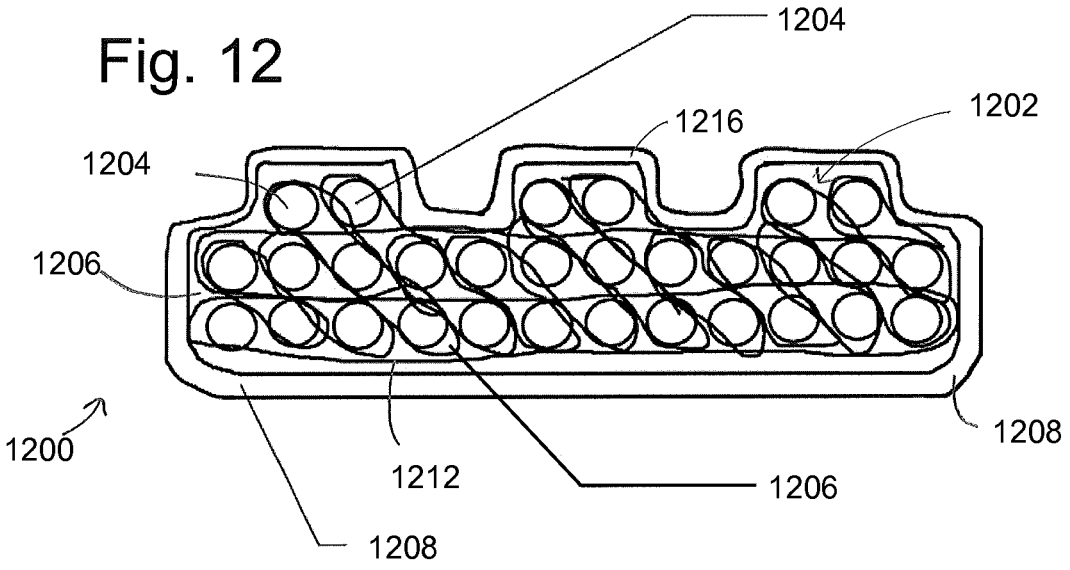

FIG. 12 depicts another cross-sectional view of an embodiment of a hoisting member (1200) in the form of a composite belt having a ribbed surface. Hoisting member (1200) can be used in elevator system (100) and is similar to hoisting member (1000) in that hoisting member (1200) comprises a composite rope structure that has a core (1202) comprised of a strength component (1204) and a matrix material (1206). Similar to strength member (1004), strength component (1204) comprises CNT surrounded or embedded in matrix material (1206), which fills out spaces or gaps between fibers and acts as a bonding material holding the CNT together. Core (1202) is surrounded by a coating (1208) to protect core (1202) while also providing an outer surface where the coefficient of friction of the outer surface can be controlled based on the type of coating (1208) used. Hoisting member (1200) comprises a plurality of ribs (1216), similar to ribs (1016), positioned on an exterior surface of hoisting member (1200). FIG. 12 shows hoisting member (1200) further comprising sheathing (1212) that is positioned or placed (e.g. by braiding or weaving etc.) throughout core (1202), similar to sheathing (812) from FIG. 8. In the present embodiment, sheathing (1212) is positioned around each row and diagonally throughout the CNT in core (1202). A single length, multiple lengths spliced together, or multiple separate lengths of sheathing (1212) can be used when positioning sheathing (1212) within core (1202).

Figure 13:
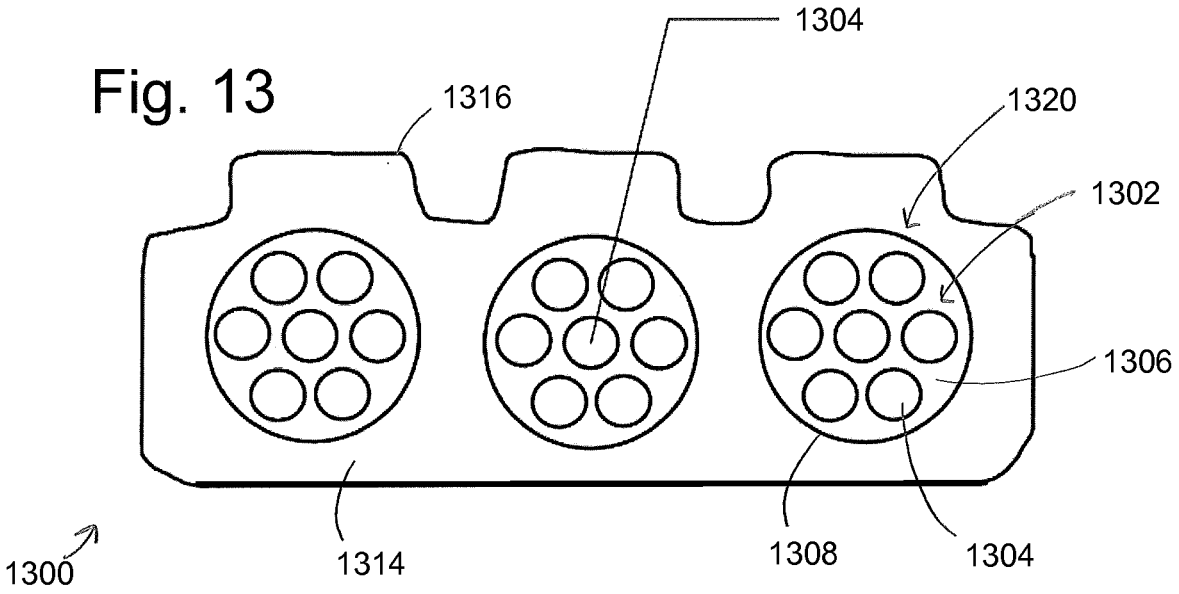

FIG. 13 depicts another cross-sectional view of an embodiment of a hoisting member (1300) in the form of a composite belt having a ribbed surface for use in elevator system (100). In the present embodiment, hoisting member (1300) comprises a plurality of interior composite members (1320). Interior composite members (1320) are similar in construction to hoisting member (200) from FIG. 2, and comprise a composite rope structure having a core (1302) comprised of a strength component (1304) and a matrix material (1306). Similar to strength member (204), strength component (1304) comprises CNT surrounded or embedded in matrix material (1306), which fills out spaces or gaps between fibers and acts as a bonding material holding the CNT together. In some embodiments, strength component (1304) can be a preassembled CNT fiber rope. Core (1302) is surrounded by a coating (1308) to protect core (1302). In some embodiments coating (1308) can be omitted, in which case the outer surface of composite members (1320) is comprised of matrix material (1306). In the present embodiment, hoisting member (1300) comprises three interior composite members (1320) that are laterally aligned. Alternatively, hoisting member (1300) can comprise any suitable number of interior composite members (1320) positioned in any suitable arrangement within hoisting member (1300).

Referring still to FIG. 13, hoisting member (1300) further comprises a coating (1314) that surrounds interior composite members (1320) and protects interior composite members (1320). In the present embodiment, coating (1314) comprises an elastomer. Still other suitable materials for coating (1314) will be apparent to one of ordinary skill in the art, in view of the teachings disclosed herein. Coating (1314) can provide an outer surface where the coefficient of friction of the outer surface can be controlled based on the type of coating (1314) used. FIG. 13 shows that coating (1314) forms a plurality of ribs (1316), similar to ribs (1016), protruding from an exterior surface of hoisting member (1300). Ribs (1316) may be complimentary to, and/or ride within, a grooved or patterned surface of traction sheave (112) to prevent slipping of hoisting member (1300) during operation of elevator system (100).

FIGS. 10-13 depict ribs (1016, 1116, 1216, 1316) aligned generally parallel with a longitudinal direction of hoisting member (1000, 1100, 1200, 1300) in three rows. However, one of skill in the art can readily recognize that various ribs orientations and patterns may be utilized without departing from the spirit and scope of the present disclosure. For example, ribs (1016, 1116, 1216, 1316) can be aligned generally perpendicular with the longitudinal direction of the hoisting member (1000, 1100, 1200, 1300) along the entirety of the hoisting member length. In another example, ribs (1016, 1116, 1216, 1316) can be aligned angled or diagonal with the longitudinal direction of the hoisting member (1000, 1100, 1200, 1300) along the entirety of the hoisting member length. In another example, one or more of the plurality of ribs (1016, 1116, 1216, 1316) can be aligned one way relative to the longitudinal direction of the hoisting member (1000, 1100, 1200, 1300) along the entirety of the hoisting member length, while another one or more of the plurality of ribs (1016, 1116, 1216, 1316) can be aligned another way relative to the longitudinal direction of the hoisting member (1000, 1100, 1200, 1300) along the entirety of the hoisting member length. In some embodiments, hoisting members (1100, 1200, 1300) may have no ribs.

Data-communication members can be incorporated into any of the hoisting members described above to transmit data and/or enable monitoring between controller (102) and elevator car (106). In some embodiments, such data-communication members include one or more optical fibers. These optical fibers can be arranged within a core of the hoisting members and/or within a coating of the hoisting members. In alternate embodiments, the one or more optical fibers are positioned in a circular arrangement within the hoisting members. In additional alternate embodiments, the one or more optical fibers are positioned laterally within the hoisting members. In still further alternate embodiments, the one or more optical fibers are interspersed randomly throughout the hoisting members. Other suitable arrangements for the one or more optical fibers will be apparent to one of ordinary skill in the art in view of the teachings herein.

Also, in some embodiments, the elevator controller (102) or a separate system can monitor hoisting member (114) for degradation or wear. For instance, since CNT yarns and fibers are conductive, the current strength can be gauged or measured by the resistance across the length of the hoisting member (114). Furthermore, based on the condition of the CNT strength components differing resistance measurements are attained. Thus the resistance measurements can be correlated with the condition, durability, or integrity of the CNT strength components and/or of the hoisting member as a whole. Similarly, other devices may be used to assess the integrity or degradation of hoisting members. Such other devices may include a giant magneto-resistance (GMR) sensor unit where the hoisting members contain magnetic materials. Exemplary GMR sensor units for use with an elevator system are described in U.S. patent application Ser. No. 14/190,016, entitled "System and Method for Monitoring a Load Bearing Member," filed Feb. 25, 2014 and incorporated by reference herein.

Sheathing comprising CNT can be incorporated into any of the hoisting members described above to provide additional structural support to the hoisting members and/or to transmit electrical signals to provide power to elevator car (106). In some embodiments, the sheathing is positioned (by braiding or weaving etc.) throughout portions of the strength components comprising CNT. In other embodiments, the sheathing is positioned throughout portions of the matrix material. In still additional alternate embodiments, the sheathing is positioned throughout portions of the data-communication member. Alternatively, the sheathing may be positioned throughout the coating of the hoisting members and/or arranged into numerous shapes or patterns, including for example a circular arrangement, a linear arrangement, a criss-cross arrangement, etc., without departing form the scope of the present disclosure. Other suitable arrangements for the sheathing will be apparent to one of ordinary skill in the art in view of the teachings disclosed herein.

In some embodiments, one or more ribs are provided on an exterior surface of the hoisting members described above to correspond to a grooved or patterned surface of fraction sheave (112) to prevent slipping of the hoisting members during operation of elevator system (100) or to enhance friction between the hoisting member and traction sheave (112). In some embodiments, the one or more ribs comprise a rectangular profile. Alternatively, the one or more ribs can include other suitable profiles, such as a square profile, a triangular profile, etc. Other suitable configurations for the one or more ribs will be apparent to one of ordinary skill in the art in view of the teachings herein.

While the hoisting members have been described above for use in an elevator system (100), such hoisting members can be used in other applications. For example, such hoisting members can be applied to crane applications, winch systems and/or tows for boats. Other suitable applications will be apparent to one of ordinary skill in the art in view of the teachings herein.

It should be understood that any one or more of the teachings, expressions, embodiments, examples, etc. disclosed herein may be combined with any one or more of the other teachings, expressions, embodiments, examples, etc. that are disclosed herein. The teachings, expressions, embodiments, examples, etc. disclosed herein should therefore not be viewed in isolation relative to each other. Various suitable ways in which numerous aspects of the present disclosure may be combined will be readily apparent to those of ordinary skill in the art in view of the teachings disclosed herein. Such modifications and variations are intended to be included within the scope of both the present disclosure and the claims.

Having shown and described various embodiments of the present disclosure, further adaptations of the methods and systems described herein may be accomplished by appropriate modifications by one of ordinary skill in the art without departing from the scope of the present disclosure. Several of such potential modifications have been mentioned, and others will be apparent to those skilled in the art. For instance, examples, embodiments, geometrics, materials, dimensions, ratios, steps, and the like discussed above are illustrative and are not required. Accordingly, the scope of the present disclosure should be considered in terms of the following claims and is understood not to be limited to the details of structure and operation shown and described in the specification and drawings.

We claim:

1. A hoisting member for moving an elevator car in an elevator system, wherein the hoisting member comprises:

a strength component comprising a plurality of carbon nanotube structures located within a core of the hoisting member;

a matrix material comprising a first polymer material that surrounds the plurality of carbon nanotube structures and binds the plurality of carbon nanotube structures together; and wherein a select one or both of power and data are transmitted to and from the elevator car via at least a portion of the plurality of carbon nanotube structures.

2. The hoisting member of claim 1 further comprising a coating comprising a second polymer that surrounds the matrix material, wherein the coating defines an outer surface of the hoisting member that is configured to contact a traction sheave of the elevator system.

3. The hoisting member of claim 1 wherein the hoisting member has a cross section having a select one of a circular shape and a rectangular shape.

4. The hoisting member of claim 1 further comprising a plurality of ribs configured to engage with a traction sheave of the elevator system.

5. The hoisting member of claim 4 wherein the plurality of ribs extends parallel in a longitudinal direction of the hoisting member.

6. The hoisting member of claim 5 further comprising a data communications member configured to transmit data to and from the elevator car.

7. The hoisting member of claim 5 further comprising a sheathing, wherein the plurality of carbon nanotube structures oriented in rows across the longitudinal direction of the hoisting member, wherein the sheathing wraps each of the plurality of carbon nanotube structures.

8. The hoisting member of claim 7 further comprising a coating comprising a second polymer that surrounds the matrix material, wherein the coating defines an outer surface of the hoisting member that is configured to contact a traction sheave of the elevator system.

9. The hoisting member of claim 5 wherein the plurality of carbon nanotube structures is grouped into a plurality of interior composite members.

10. The hoisting member of claim 5 further comprising a coating comprising a second polymer that surrounds the matrix material, wherein the coating defines an outer surface of the hoisting member that is configured to contact a traction sheave of the elevator system.

11. The hoisting member of claim 1 further comprising a data communications member configured to transmit data to and from the elevator car.

12. The hoisting member of claim 11 wherein the data communications member is surrounded by at least a portion of the plurality of carbon nanotube structures.

13. The hoisting member of claim 1 further comprising a sheathing that surrounds at least a portion of the plurality of carbon nanotube structures and is embedded within the matrix material.

14. The hoisting member of claim 13 wherein the sheathing comprises carbon nanotube material.

15. The hoisting member of claim 13 wherein the plurality of carbon nanotube structures is oriented to have a hexagonal shaped cross section.

16. The hoisting member of claim 15 wherein the plurality of carbon nanotube structures is oriented to form a plurality of diagonal rows, wherein a sheathing wraps each row of the plurality of diagonal rows.

17. The hoisting member of claim 13 further comprising a data communications member configured to transmit data to and from the elevator car.

18. The hoisting member of claim 1 further comprising a plurality of strips of fiber tape embedded within the matrix material.

19. An elevator system without a trailing cable, the elevator system comprising:

an elevator controller;

an elevator car;

a traction sheave; and a hoisting member comprising a plurality of carbon nanotube structures embedded in a polymeric matrix material to bind the plurality of carbon nanotube structures together, wherein the hoisting member is configured to transmit a select one or both of power and data to and from the elevator car via at least a portion of the plurality of carbon nanotube structures.

* * * * *